United States Patent [19]

Hayman et al.

[11] Patent Number: 4,807,306

[45] Date of Patent: Feb. 28, 1989

[54] POP-UP DRAIN ASSEMBLY FOR LAVATORY BASINS

[75] Inventors: Dennis J. Hayman, Plano; David M. Pearce, Abilene, both of Tex.

[73] Assignee: United States Brass Corporation, Plano, Tex.

[21] Appl. No.: 77,167

[22] Filed: Jul. 24, 1987

Related U.S. Application Data

[63] Continuation of Ser. No. 946,312, Dec. 23, 1986, abandoned, which is a continuation of Ser. No. 844,140, Mar. 26, 1986, abandoned.

[51] Int. Cl.[4] ..... E03C 1/22

[52] U.S. Cl. ..... 4/203

[58] Field of Search ..... 4/194, 197, 198, 200, 4/203, 288; 251/231, 279, 280

[56] References Cited

U.S. PATENT DOCUMENTS

| | | | |
|---|---|---|---|
| 1,848,521 | 3/1932 | Fleck | 4/203 |
| 1,958,992 | 5/1934 | Fraser | 4/200 |
| 2,091,170 | 8/1937 | Tilden | 4/200 |
| 2,282,212 | 5/1942 | Pope | 4/288 |
| 2,288,767 | 7/1942 | Young | 4/200 |
| 2,461,812 | 2/1949 | De Grave et al. | 4/198 |
| 3,314,083 | 4/1967 | Minella | 4/200 |
| 3,731,326 | 5/1973 | Politz | 4/203 |
| 4,218,785 | 8/1980 | Crawford et al. | 4/203 |

FOREIGN PATENT DOCUMENTS

| | | | |
|---|---|---|---|
| 1255751 | 1/1961 | France | 4/203 |
| 2374481 | 12/1976 | France | 4/197 |

*Primary Examiner*—Charles E. Phillips

*Attorney, Agent, or Firm*—James C. Fails; Arthur F. Zobal

[57] ABSTRACT

There is disclosed improved pop-up drain assemblies for lavatory basins, with unique structure involving the removable inner seat and compression nut receiver portion, the removable inner seat member for the rod bearing part, and the drain conduit portion.

11 Claims, 2 Drawing Sheets

POP-UP DRAIN ASSEMBLY FOR LAVATORY BASINS

CROSS-REFERENCE TO RELATED APPLICATIONS

This application is a continuation of application Ser. No. 06/946,312, filed Dec. 23, 1986, which was a continuation of original application Ser. No. 06/844,140 filed by Dennis J. Hayman et al on Mar. 26, 1986 for "IMPROVED POP-UP DRAIN ASSEMBLY FOR LAVATORY BASINS", now both abandoned.

FIELD OF INVENTION

The invention relates to pop-up drain assemblies for lavatory basins in the plumbing field.

BACKGROUND OF INVENTION

Pop-up drain assemblies for lavatory basins in the prior art have commonly utilized a drain conduit means in the form of a cylindrical tube having an extensive threaded portion at its upper end for receiving a washer and gasket and a flange, for fixing the drain conduit means in the installed condition on the lavatory basin. Said prior art assemblies further commonly utilize a horizontal rod and rod bearing member and bearing seat and retaining means including a removable inner seat member for the rod bearing member, a compression nut and outer seat for the rod bearing member, and an inner seat member and compression nut receiving means that is integral with the cylindrical tube and projects laterally outward therefrom. The prior art removable inner seat member is commonly an insert ring having a short cylindrical exterior surface that is matingly received by a cylindrical counterbore in the inner seat member and compression nut receiving means and having an outwardly facing bearing surface shaped to cooperate with the rod bearing member.

The market for the relevant pop-up drain assemblies is highly competitive with the result that cost reductions are important. It is accordingly the objective of this invention to provide improved pop-up drain assemblies which are functionally sound and durable and which can be marketed and installed more economically than those of the prior art.

DESCRIPTION OF PREFERRED EMBODIMENTS

Figure 1:
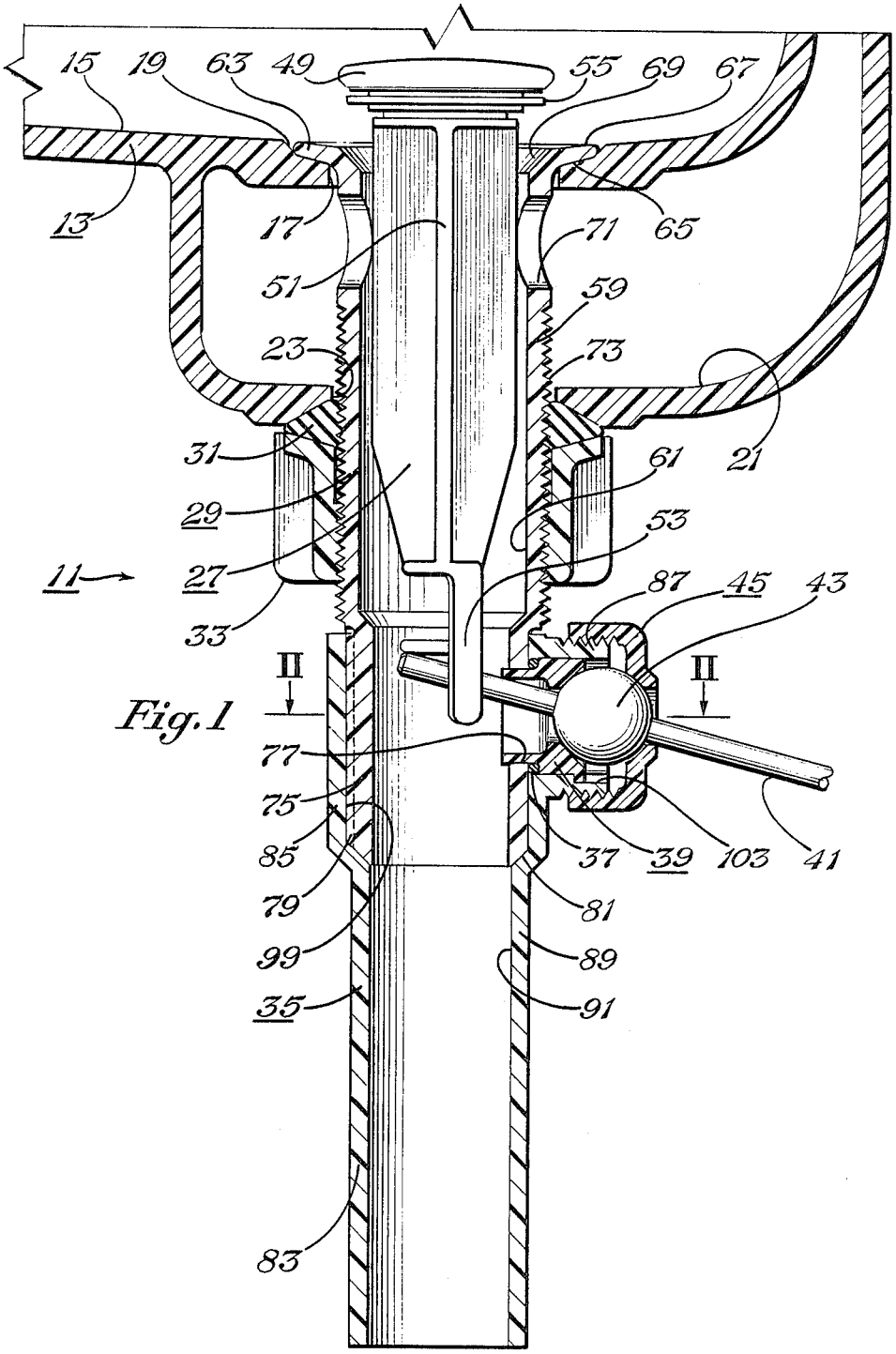
FIG. 1 is a schematic vertical section view showing an improved pop-up drain assembly for a lavatory basin in accordance with a preferred embodiment of the invention.

In FIG. 1, there is shown a vertical section view of a pop-up drain assembly 11 of the present invention, in accordance with a preferred embodiment, installed on a lavatory basin 13. The lavatory basin 13 is of a conventional type, having sidewalls and a bottom wall 15. The lavatory basin bottom wall 15 has, at its lowest point, a circular drain opening 17. The peripheral surface 19 around the lavatory basin drain opening 17 is recessed from the upper surface of the bottom wall 15 for receiving a flanged portion of the pop-up drain assembly 11. Beneath the lavatory basin bottom wall 15 is an overflow chamber 21. Communication between the overflow chamber 21 and the upper portion of the lavatory basin 13 is through an opening in the lavatory basin side wall (not shown). The bottom wall of the overflow chamber has a circular drain conduit means exit opening 23 located directly beneath and coaxial to the lavatory basin drain opening 17. The outer surface of the overflow chamber bottom wall around the drain conduit means exit opening 23 is chamfered.

The pop-up drain assembly 11 shown in FIG. 1 includes a pop-up plug 27, a flange piece 29, a gasket 31, a mounting nut 33, a tail piece 35, a seal ring 37, a removable inner seat member 39, a horizontal rod 41, a rod bearing member 43, and a compression nut 45.

The pop-up plug 27 is of a conventional type and has a cap portion 49, a connector portion 51, and a lower end portion 53. The cap portion has a flapper seal 55, the purpose of which will be explained hereinafter. The connector portion 51, consisting of radially extending ribs disposed 90° from each other, extends axially from the cap portion 49 to the lower end portion 53. Once a pop-up drain assembly 11 is assembled, the lower end portion 53 of the pop-up plug 27 coacts with the inner end portion of the horizontal rod 41 to enable the pop-up plug to be moved up and down.

The flange piece 29 is generally cylindrical in shape and has a side wall 59 and a central drain channel 61 for receiving the pop-up plug 27. At the upper end of the flange piece 29 is a flange 63 that extends radially outward and has a slight longitudinal inclination such that when the flange piece is installed in the lavatory basin 13 the bottom surface 65 of the flange fully engages conventional sealant material which in turn fully engages the recessed peripheral surface 19 around the lavatory basin drain opening 17 and the top surface 67 of the flange is substantially at the level of the upper surface of the lavatory basin bottom wall 15. The top surface 67 of the flange merges with a chamfered surface 69 that surrounds the opening to the drain channel 61 and sealingly engages the flapper seal 55 of the pop-up plug 27 when the pop-up plug is in the down position. The chamfered surface 69 merges with the inner surface of the sidewall 59. Just below the flange 63 are overflow drain openings 71. When the pop-up drain assembly 11 is installed on the lavatory basin 13, the overflow drain openings 71 allow communication between the overflow chamber 21 and the drain channel 61. The flange piece has external threads 73 around its central portion, below the overflow drain openings 71, for matingly engaging internal threads of the mounting nut.

At the lower end portion 75 of the flange piece the outside diameter of the sidewall 59 is reduced to telescopically engage the upper end portion of the tail piece 35. As a result, the inside diameter of the drain channel 61 is reduced slightly in the lower end portion 75 of the flange piece. The portion of the sidewall 59 that forms the lower end portion of the flange piece has a circular sidewall opening 77. The sidewall opening 77 is positioned an appropriate longitudinal distance from the flange piece chamfered surface 69, located at the top end of the flange piece, so as to allow coaction between the inner end portion of the horizontal rod 41, which is inserted through the sidewall opening and into the drain channel 61, and the lower end portion 53 of the pop-up plug. Furthermore, the sidewall opening 77 penetrates through the sidewall such that the sidewall opening will receive a cylindrical body having a central axis that is normal to the central axis of the drain channel. Diametrically opposed to the center of the sidewall opening is a keyway projection 79 that extends the length of the lower end portion 75 of the flange piece in a longitudinal direction. Merging with the outside surface of the sidewall 59 is a chamfered surface 81 located at the bottom-most portion of the flange piece lower end portion 75. The chamfered surface 81 eases insertion of the flange piece 29 into the tail piece 35.

Figure 3:
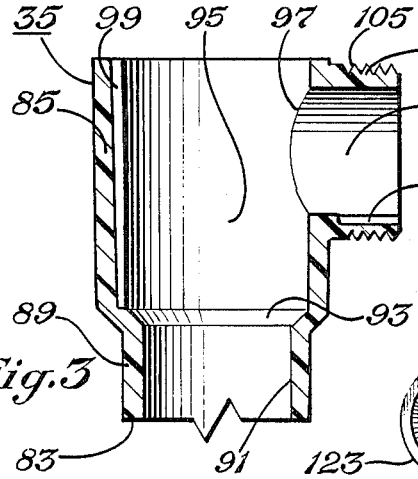
FIG. 3 is a fragmentary schematic vertical section view showing the upper end portion of a tail piece.
Figure 4:
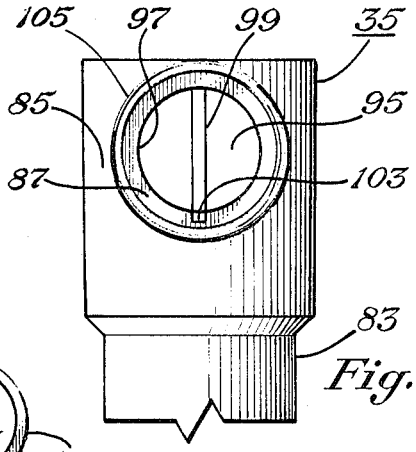
FIG. 4 is a schematic side elevational view showing the upper end portion of the tail piece of FIG. 3.
Figure 5:
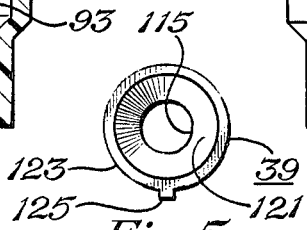
FIG. 5 is a schematic plan view of the removable inner seat member of FIG. 1.
Figure 6:
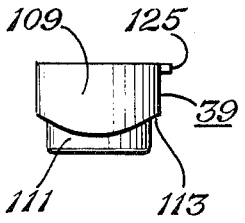
FIG. 6 is a side elevational view of the removable inner seat member of FIG. 5.
Figure 7:
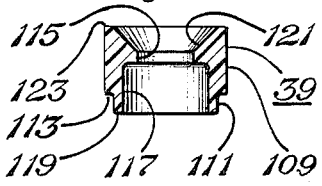
FIG. 7 is a vertical section view of the removable inner seat member of FIG. 5.
Figure 8:
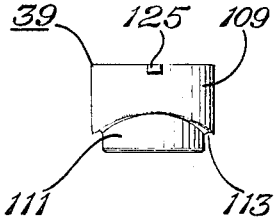
FIG. 8 is a side elevational view of the removable inner seat member of FIG. 6 but displaced 90°.

Referring now in particular to FIGS. 3 and 4, the tail piece 35 includes a lower end portion 83, a flange piece receiving portion 85, and an inner seat member and compression nut receiving portion 87, all integrally formed together. The tail piece 35, like the flange piece 29, is generally cylindrical in shape and has a sidewall 89 which forms a central drain channel 91 in the lower end portion 83. At the upper end of the tail piece lower end portion 83 the sidewall 89 flares outwardly to an inside diameter that is substantially equal to the outside diameter of the flange piece lower end portion 75, thus forming the flange piece receiving portion 85. The flange piece receiving portion 85 and the flange piece lower end portion 75 have a slight taper (now shown) so as to form a mutual seal when fully assembled. The inner surface of the sidewall 89 merges with a chamfered surface 93 which in turn merges with the inner surface 95 of the flange piece receiving portion 85. The flange piece receiving portion 85 has an opening 97 in the sidewall of slightly larger diameter than the flange piece sidewall opening 77. The tail piece sidewall opening 97 is located on the flange piece receiving portion 85 so as to be coaxial with the flange piece sidewall opening 77, when the flange piece 29 is assembled into the tail piece 35. Opposite the tail piece sidewall opening is a keyway slot 99 in the inner surface 95 of the flange piece receiving portion 85. The keyway slot 99 receives the flange piece keyway projection 79.

The inner seat member and compression nut receiving portion 87 projects radially outward from the flange piece receiving portion 85 and has a cylindrical inner surface 101 that is coaxial and of equal diameter to the sidewall opening 97. The inner surface 101 of the inner seat member and compression nut receiving portion 87 extends from the sidewall opening 97 to the open outer end of the inner seat member and compression nut receiving portion. The central axis of the inner seat member and compression nut receiving portion 87 is normal to the central axis of the tail piece drain channel 91. A keyway slot 103 that is longitudinal to the central axis of the inner seat member and compression nut receiving portion 87 traverses a short distance from the open end of the inner seat portion and compression nut receiving member 87 towards the sidewall opening 97. Exterior threads 105 on the inner seat member and compression nut receiving portion 87 are sized to matingly engage interior threads 133 on the compression nut.

The removable inner seat member 39 has cylindrical first and second exterior surface portions 109, 111 and a shoulder portion 133 (see FIGS. 5 through 8). The first exterior surface portion 109 is sized to be matingly received by the inner seat member and compression nut receiving portion inner surface 101 and the second exterior surface portion 111 is sized to be matingly received by the sidewall opening 77 of the flange piece lower end portion 75. The shoulder portion 113 is interposed between the adjacent ends of inner seat member first and second exterior surface portions 109, 111. The shoulder portion 113 is shaped to conform with the circumference of the flange piece sidewall opening 77. A cylindrical central bore 115 extends through the removable inner seat member 39. A cylindrical counterbore 117 extends from the inner end of the removable inner seat member 39 to about midway through the member 39. The surface of the second exterior surface portion 111 merges with an inner end surface 119 which is annular in shape. The inner end surface 119 merges with the interior surface of the cylindrical counterbore 117. At the outer end of the removable inner seat member 39, a counterbore forms an inner seat surface 121 for the horizontal rod bearing member 43. The inner seat surface 121 merges with an annular shaped outer end surface 123 which in turn merges with the surface of the first exterior surface portion 109. A keyway tab 125 protrudes radially outward from the outer end of the removable inner seat member 39 and is sized to be received by the keyway slot 99 of the tail piece inner seat member and compression nut receiving portion 87.

The horizontal rod 41 and rod bearing member 43 are conventional parts in pop-up drain assemblies and thus will only be described in limited detail (see FIG. 1). The horizontal rod 41 extends through the spherical rod bearing member 43 so that a portion of the horizontal rod is on both sides of the rod bearing member. On the inner side of the rod bearing member 43, the horizontal rod 41 is sufficiently long so that when installed, the horizontal rod extends into the drain channel 61 and is able to coact with the pop-up plug 27. On the outer side of the rod bearing member 43, the horizontal rod 41 is long enough to cooperate with the lift rod linkage (not shown) that is commonly used with pop-up drain assemblies.

Figure 2:
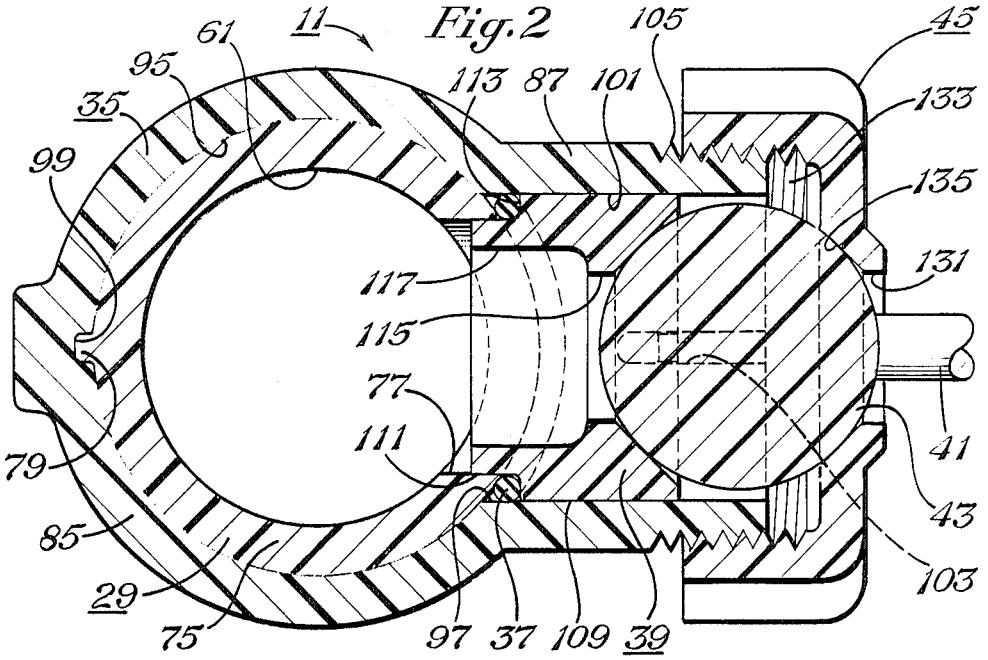
FIG. 2 is an enlarged schematic horizontal section view taken at lines II—II of FIG. 1.

The compression nut 45 has a central bore 131 (see FIG. 2) for receiving the outer portion of the horizontal rod 41. A large counterbore traverses from the inside end of the compression nut towards the outside end, and has internal threads 133 sized to matingly engage the external threads 105 on the inner seat member and compression nut receiving portion 87. The counterbore forms a shoulder surface that merges with an outer seat surface 135 for the the rod bearing member 43.

To assemble the pop-up drain assembly 11 of the present invention, the flange piece 29 is inserted, lower end portion 75 first, into the lavatory basin drain opening 17 and allowed to drop through the drain conduit means exit opening 23. The flange 63 of the flange piece bears on suitable sealing material which in turn bears on the recessed peripheral surface 19 of the lavatory basin. The gasket 31 is then installed on the threaded portion 73 of the flange piece and the mounting nut 33 is then screwed upwardly on the threaded portion 73 of the flange piece until the gasket seats on the chamfered surface of the lavatory basin, around the drain conduit means exit opening 23.

Next, the tail piece 35 is oriented beneath the flange piece so that the keyway projection 79 of the flange piece is aligned with the keyway slot 99 of the tail piece. The tail piece is then pushed up onto the flange piece, such that the flange piece receiving portion 85 of the tail piece telescopically receives the lower end portion 75 of the flange piece. The tail piece 35 is fully assembled onto the flange piece 29 when the sidewall openings 77, 97 are coaxial. A continuous drain channel is formed by the flange piece 29 and the tail piece 35. Then, the seal ring 37 is assembled onto the second exterior portion 111 of the removable inner seat member 39. The removable inner seat member 39 is oriented to the inner seat member and compression nut receiving portion 87 of the tail piece such that the removable inner seat member keyway tab 125 is aligned with the tail piece keyway slot 103. The removable inner seat member 39 is then inserted into the inner seat member and compression nut receiving portion 87 so that the inner surface 101 of the inner seat member and compression nut receiving portion 87 matingly receives the removable inner seat member first exterior surface portion 109, the flange piece sidewall opening 77 matingly receives the removable inner seat member second exterior surface portion 111, and the seal ring 37 is pushed up against the removable inner seat member shoulder portion 113 by the lower end portion 75 of the flange piece sidewall 59.

Next, the horizontal rod 41 and rod bearing member 43 are installed by inserting the inner end of the horizontal rod through the central bore 115 of the removable inner seat member and into the drain channel 61, until the rod bearing member contacts the inner seat surface 121. The compression nut is then assembled onto the inner seat member and compression rod receiving portion 87 of the tail piece, after allowing the outer end of the horizontal rod 41 to extend through the compression nut central bore 131. The rod bearing member 43 bearingly engages the inner seat surface 121 of the removable inner seat member 39 and the outer seat surface 135 of the compression nut 45. As the compression nut 45 is tightened onto the tail piece 35, the seal ring 37 is compressed by the inward movement of the removable inner seat member 39 which is pushed by the rod bearing member 43, forming a seal between the removable inner seat member 39 and the tail piece 35. Another seal is formed by the rod bearing member 43 and the removable inner seat member 39.

Finally, the pop-up plug 27 is dropped into the drain channel from the lavatory basin 13. The lower end portion 53 of the pop-up plug coacts with the inner end portion of the horizontal rod 41. As the horizontal rod 41 pivots around the rod bearing member 43, the inner end portion of the horizontal rod will alternatively rise and fall inside of the drain channel, thus moving the pop-up plug respectively up and down to selectively open or close the basin drain.

A particular characteristic of a pop-up drain assembly embodying the present invention is that the removable inner seat member 39 has a second exterior surface portion 111 shaped to be matingly received by the drain conduit means sidewall opening 77. In the embodiment shown, the drain conduit means is made up of a flange piece 29 which is telescopically received by a tail piece 35. The second exterior surface portion 111 in cooperation with the first exterior surface portion 109 of the removable inner seat member 39 locks the flange piece 29 and the tail piece 35 in the telescoped position upon assembly. Also, in the preferred embodiments of the invention, the shoulder portion 113 of the removable inner seat member 39 is shaped to conform with the circumference of the drain conduit means sidewall opening 77, so that a seal ring can be compressed between the shoulder portion 113 and the exterior surface of the drain conduit means that is adjacent to the circumference of the drain conduit means sidewall opening 77.

In the embodiment shown, the flange piece 29 and the tail piece 35 are preferably made of plastic material, and the telescoping portions of the flange piece and tail piece are preferably provided means 79, 99 coacting to radially align the flange piece and tail piece sidewall openings 77, 97. In all embodiments of the invention, the first and second exterior surface portions 109, 111 of the removable inner seat member 39 are preferably cylindrical, and the inner seat and compression nut receiving means 87 and the removable inner seat member 39 are preferably provided means 103, 125 coacting to properly orient the removable seat member 39 in relation to the circumference of the drain conduit means sidewall opening 77.

The foregoing disclosure and the showings made in the drawings are merely illustrative of the principles of this invention and are not to be interpreted in a limiting sense.

We claim:

1. In a pop-up drain assembly for a lavatory basin having a drain opening, which assembly includes drain conduit means having a flange portion for bearing on the peripheral surface of said basin drain opening, at least one upper lateral opening, at least one lower lateral opening and a sidewall, means for fixing said drain conduit means in the installed condition on said lavatory basin, a pop-up plug for selectively opening or closing the basin drain, a horizontal rod and rod bearing member, and bearing seat and retaining means for said rod bearing member, the improvement characterized by:

a. said bearing seat and retaining means including a removable inner seat member for said rod bearing member, a compression nut and outer seat for said rod bearing member, and an inner seat member and compression nut receiving means fixed relative to said drain conduit means and projecting laterally outward therefrom;

b. said inner seat and compression nut receiving means having an inner surface disposed to be coaxial with said lower lateral opening in the sidewall of said drain conduit means and shaped to matingly receive a first exterior surface portion of said removable inner seat member, and further having a threaded portion adapted for matingly receiving a threaded portion of said compression nut;

c. said removable inner seat member having a seat surface adjacent one end shaped to bearingly engage an inner portion of said rod bearing member and having a second exterior surface portion adjacent the other end and shaped to be matingly received by said drain comduit means lower sidewall opening;

d. said compression nut acting to move said outer seat into contact with an outer portion of said rod bearing member so as to sealingly capture said rod bearing member, with an inner end portion of said horizontal rod projecting into said drain conduit means in coacting relation with the lower end portion of said pop-up plug;

wherein said drain conduit means includes a flange piece and a tail piece with the upper end portion of said tail piece being sized to telescopically receive the lower end portion of said flange piece, with said flange piece and said tail piece having respective sidewall openings that are coaxial so that said removable inner seat member first and second exterior surface portions act to lock said flange piece and said tail piece in the telescoped position when said device is assembled.

2. The device of claim 1 wherein said removable inner seat member first and second exterior surface portions are cylindrical.

3. The device of claim 1 wherein said inner seat and compression nut receiving means and said removable inner seat member are provided means coacting to properly orient said removable inner seat member in relation to said flange piece sidewall opening.

4. The device of claim 1 wherein the telescoping portions of said flange piece and said tail piece are provided means coacting to radially align said flange piece and tail piece sidewall openings.

5. In a pop-up drain assembly for a lavatory basin having a drain opening, which assembly includes drain conduit means having a flange portion for bearing on the peripheral surface of said basin drain opening, at least one upper lateral opening, at least one lower lateral opening and a sidewall, means for fixing said drain conduit means in the installed condition on said lavatory basin, a pop-up plug for selectively opening or closing the basin drain, a horizontal rod and rod bearing member, and bearing seat and retaining means for said rod bearing member, the improvement characterized by:

a. said bearing seat and retaining means including a removable inner seat member for said rod bearing member, a compression nut and outer seat for said rod bearing member, and an inner seat member and compression nut receiving means fixed relative to said drain conduit means and projecting laterally outward therefrom;

b. said inner seat and compression nut receiving means having an inner surface disposed to be coaxial with said lower lateral opening in the sidewall of said drain conduit means and shaped to matingly receive a first exterior surface portion of said removable inner seat member, and further having a threaded portion adapted for matingly receiving a threaded portion of said compression nut;

c. said removable inner seat member having a seat surface adjacent one end shaped to bearingly engage an inner portion of said rod bearing member and having a second exterior surface portion adjacent the other end and shaped to be matingly received by said drain conduit means lower sidewall opening;

d. said compression nut acting to move said outer seat into contact with an outer portion of said rod bearing member so as to sealingly capture said rod bearing member, with an inner end portion of said horizontal rod projecting into said drain conduit means in coacting relation with the lower end portion of said pop-up plug;

wherein a shoulder portion is interposed between the adjacent ends of said removable inner seat member first and second exterior surface portions and is shaped to conform with the circumference of the drain conduit means lower side wall opening and a seal ring is installed on said second exterior surface portion in contact with said shoulder portion so that said seal ring may be compressed by the inward movement of said removable inner seat member when said compression nut is installed; and wherein said drain conduit means includes a flange piece and a tail piece with the upper end portion of said tailpiece being sized to telescopically receive the lower end portion of said flange piece, with said flange piece and said tail piece having respective sidewall openings that are coaxial, so that said removable inner seat member first and second exterior surface portions act to lock said flange piece and said tail piece in the telescoped position when said device is assembled.

6. The device of claim 5 wherein said removable inner seat member first and second exterior surface portions are cylindrical.

7. The device of claim 6 wherein the telescoping portions of said flange piece and said tail piece are provided means coacting to radially align said flange piece and tail piece sidewall openings.

8. The device of claim 7 wherein said inner seat and compression nut receiving means and said removable inner seat member are provided means coacting to properly orient said removable inner seat member in relation to said drain conduit means sidewall opening.

9. The device of claim 5 wherein said inner seat and compression nut receiving means and said removable inner seat member are provided means coacting to properly orient said removable inner seat member in relation to said flange piece sidewall opening.

10. The device of claim 9 wherein the telescoping portions of said flange piece and said tail piece are provided means coacting to radially align said flange piece and tail piece sidewall openings.

11. The device of claim 5 wherein the telescoping portions of said flange piece and said tail piece are provided means coacting to radially align said flange piece and tail piece sidewall openings.

* * * * *